US009718128B2

(12) United States Patent
Mizobe et al.

(10) Patent No.: US 9,718,128 B2
(45) Date of Patent: Aug. 1, 2017

(54) METHOD FOR USING UPPER NOZZLE

(71) Applicant: KROSAKIHARIMA CORPORATION, Fukuoka (JP)

(72) Inventors: Arito Mizobe, Fukuoka (JP); Kento Furukawa, Fukuoka (JP); Tetsuo Tsuduki, Fukuoka (JP); Masaki Yamamoto, Fukkuoka (JP); Joji Kurisu, Fukuoka (JP)

(73) Assignee: KROSAKIHARIMA CORPORATION, Fukuoka (JP)

( * ) Notice: Subject to any disclaimer, the term of this patent is extended or adjusted under 35 U.S.C. 154(b) by 139 days.

(21) Appl. No.: 14/414,208

(22) PCT Filed: Dec. 12, 2012

(86) PCT No.: PCT/JP2012/082181

§ 371 (c)(1),
(2) Date: Jan. 12, 2015

(87) PCT Pub. No.: WO2014/010136

PCT Pub. Date: Jan. 16, 2014

(65) Prior Publication Data

US 2015/0196954 A1 Jul. 16, 2015

(30) Foreign Application Priority Data

Jul. 13, 2012 (JP) ..... 2012-157860
Oct. 9, 2012 (JP) ..... 2012-224458

(51) Int. Cl.
*B22D 41/50* (2006.01)
*B22D 41/08* (2006.01)
*B22D 41/58* (2006.01)

(52) U.S. Cl.
CPC ..... *B22D 41/50* (2013.01); *B22D 41/08* (2013.01); *B22D 41/58* (2013.01)

(58) Field of Classification Search
CPC ..... B22D 41/08; B22D 41/50; B22D 41/58
(Continued)

(56) References Cited

U.S. PATENT DOCUMENTS 4,360,190 A * 11/1982 Ato ..... B22D 41/58 222/603
4,427,184 A * 1/1984 Steinwider ..... C21C 5/4653 266/236

(Continued)

FOREIGN PATENT DOCUMENTS

| | | |
|---|---|---|
| JP | 01-084860 | 6/1989 |
| JP | 2012101250 | 5/2012 |
| WO | 2009113662 | 9/2009 |

OTHER PUBLICATIONS

International Search report for PCT/JP2012/082181 filed Dec. 12, 2012.

(Continued)

*Primary Examiner* — Scott Kastler
*Assistant Examiner* — Michael Aboagye
(74) *Attorney, Agent, or Firm* — Paul D. Bianco; Stephen Bongini; Fleit Gibbons Gutman Bongini & Bianco PL

(57) ABSTRACT

With a view to adding, to an upper nozzle formed with a bore having a shape capable of creating a less energy loss or smooth (constant) molten steel flow to suppress the occurrence of adhesion of inclusions and metals in molten steel, a gas injection function to thereby further suppress the occurrence of the adhesion, the present invention provides a method of using an upper nozzle configured to have a cross-sectional shape of a wall surface defining the bore, taken along an axis of the bore, comprising a curve represented by the following formula: $\log(r(z))=(1/n)\times\log((H+L)/(H+z))+\log(r(L))$ (n=1.5 to 6), where: L is a length of the upper nozzle; H is a calculational hydrostatic head height; and r (z) is an inner radius of the bore at a position downwardly away from an upper edge of the bore by a distance z. The method comprises using the upper nozzle in such a manner as to satisfy the following relationship: $R_G \leq 4.3\times V_L$, where $R_G$ is a gas rate defined as a volume ratio of a flow rate $Q_G$ (Nl/s) of injection gas to a flow rate $Q_L$ (l/s) of molten steel flowing through the bore ($R_G=(Q_G/Q_L)\times 100$ (%)), and $V_L$ is a flow speed of the molten steel at a lower edge of the upper nozzle.

1 Claim, 6 Drawing Sheets

(58) Field of Classification Search
USPC ..... 222/590, 591, 600, 603, 606, 607; 164/437; 266/220, 236
See application file for complete search history.

(56) References Cited

U.S. PATENT DOCUMENTS

| | | | | |
|---|---|---|---|---|
| 4,510,191 | A * | 4/1985 | Kagami | B22D 41/52 164/349 |
| 5,587,101 | A * | 12/1996 | Hattanda | B22D 41/58 222/603 |
| 8,240,524 | B2 | 8/2012 | Mizobe et al. | |
| 2010/0219212 | A1* | 9/2010 | Mizobe | B22D 41/50 222/591 |
| 2011/0017784 | A1* | 1/2011 | Mizobe | B22D 41/50 222/591 |

OTHER PUBLICATIONS

English translation of International Search report for PCT/JP2012/082181 filed Dec. 12, 2012.
Written Opinion for PCT/JP2012/082181 filed Dec. 12, 2012 (with English translation).
International Preliminary Report on Patentability for PCT/JP2012/082181 dated Jan. 13, 2015 (with English translation).

* cited by examiner

| Shape | Conventional shape | Inventive shape |
|---|---|---|
| Nozzle inner diameter 2r(0) (mm) | 70 | 70 |
| Nozzle inner diameter 2r(230) (mm) | 140 | 140 |
| Nozzle length L (mm) | 230 | 230 |
| Fluid flow speed $V_L$ (m/s) | 1.17 | 1.17 |
| Fluid flow rate $Q_L$ (l/s) | 4.49 | 4.49 |
| Injection gas flow rate $Q_G$ (Nl/s) | 0.083 | 0.083 |
| Gas rate $R_G$ (%) | 1.9 | 1.9 |
| $R_G / V_L$ | 1.6 | 1.6 |
| CFD flow state | | |
| Occurrence or non-occurrence of turbulence | Occurrence | Non-occurrence |
| Evaluation | × | ○ |

| | (a) Even injection from each region | (b) 60% injection from region B3 | (c) 70% injection from region B3 | (d) 80% injection from region B3 | (e) 100% injection from region B3 |
|---|---|---|---|---|---|
| Nozzle inner diameter 2r(0) (mm) | 65 | 65 | 65 | 65 | 65 |
| Nozzle inner diameter 2r(230) (mm) | 185 | 185 | 185 | 185 | 185 |
| Nozzle length L (mm) | 253 | 253 | 253 | 253 | 253 |
| Fluid flow speed $V_L$ (m/s) | 1.22 | 1.22 | 1.22 | 1.22 | 1.22 |
| Injection gas flow rate $Q_G$ (Nl/s) | 0.1 | 0.1 | 0.1 | 0.1 | 0.1 |
| Gas rate $R_G$ (%) | 2.5 | 2.5 | 2.5 | 2.5 | 2.5 |
| $R_G / V_L$ | 2 | 2 | 2 | 2 | 2 |
| CFD flow state | | Injection in amount of 60% of total gas flow rate | Injection in amount of 70% of total gas flow rate | Injection in amount of 80% of total gas flow rate | Injection in amount of 100% of total gas flow rate |
| Occurrence or non-occurrence of turbulence | Non-occurrence | Non-occurrence | Slight occurrence | Occurrence | Occurrence |
| Evaluation | ○ | ○ | △ | × | × |

FIG. 4A

| | (a) 60% injection from region B1 | (b) 60% injection from region B2 | (c) 60% injection from region B3 | (d) 60% injection from region B4 | (e) 60% injection from region B5 |
|---|---|---|---|---|---|
| Nozzle inner diameter 2r(0) (mm) | 65 | 65 | 65 | 65 | 65 |
| Nozzle inner diameter 2r(230) (mm) | 185 | 185 | 185 | 185 | 185 |
| Nozzle length L (mm) | 253 | 253 | 253 | 253 | 253 |
| Fluid flow speed $V_L$ (m/s) | 1.22 | 1.22 | 1.22 | 1.22 | 1.22 |
| Injection gas flow rate $Q_G$ (Nl/s) | 0.1 | 0.1 | 0.1 | 0.1 | 0.1 |
| Gas rate $R_G$ (%) | 2.5 | 2.5 | 2.5 | 2.5 | 2.5 |
| $R_G$ / $V_L$ | 2 | 2 | 2 | 2 | 2 |
| CFD flow state | 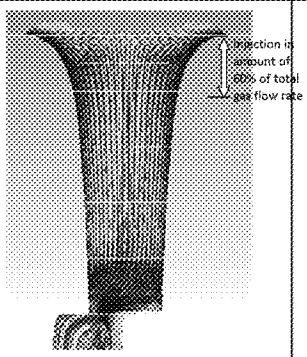  | 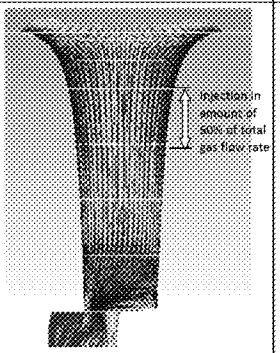  | 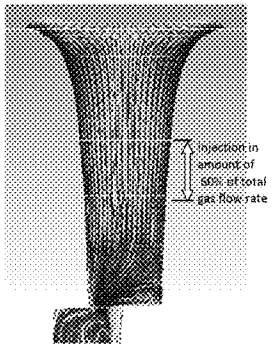  | 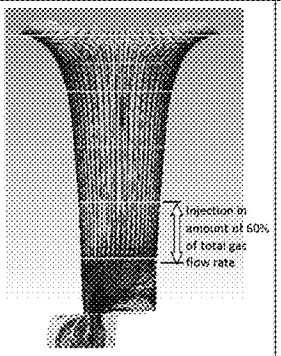  | 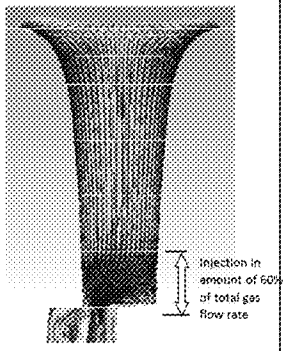  |
| Occurrence or non-occurrence of turbulence | Non-occurrence | Non-occurrence | Non-occurrence | Non-occurrence | Non-occurrence |
| Evaluation | ○ | ○ | ○ | ○ | ○ |

FIG. 4B

| | (a) 70% injection from region B1 | (b) 70% injection from region B2 | (c) 70% injection from region B3 | (d) 70% injection from region B4 | (e) 70% injection from region B5 |
|---|---|---|---|---|---|
| Nozzle inner diameter 2r(0) (mm) | 65 | 65 | 65 | 65 | 65 |
| Nozzle inner diameter 2r(230) (mm) | 185 | 185 | 185 | 185 | 185 |
| Nozzle length L (mm) | 253 | 253 | 253 | 253 | 253 |
| Fluid flow speed $V_L$ (m/s) | 1.22 | 1.22 | 1.22 | 1.22 | 1.22 |
| Injection gas flow rate $Q_G$ (Nl/s) | 0.1 | 0.1 | 0.1 | 0.1 | 0.1 |
| Gas rate $R_G$ (%) | 2.5 | 2.5 | 2.5 | 2.5 | 2.5 |
| $R_G / V_L$ | 2 | 2 | 2 | 2 | 2 |
| CFD flow state | 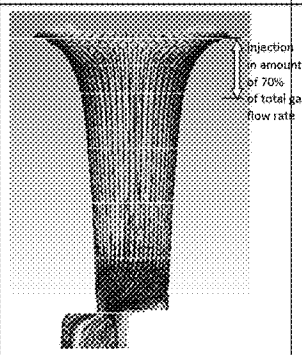  | 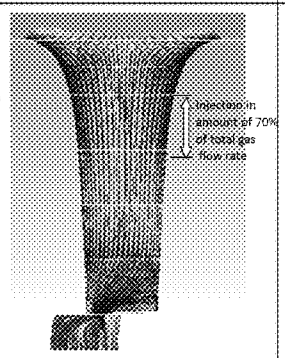  | 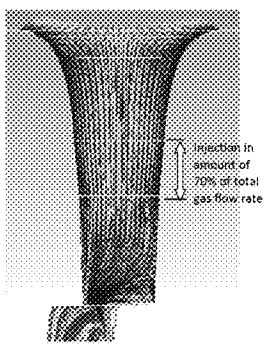  | 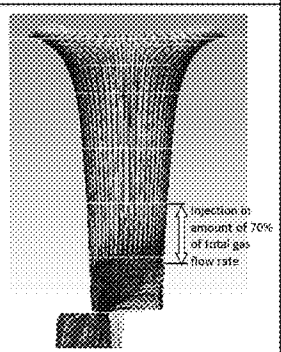  | 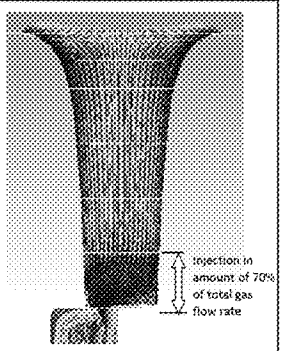  |
| Occurrence or non-occurrence of turbulence | Slight occurrence | Slight occurrence | Slight occurrence | Slight occurrence | Slight occurrence |
| Evaluation | △ | △ | △ | △ | △ |

FIG. 4C

| | (a) | (b) | (c) |
|---|---|---|---|
| Nozzle inner diameter 2r(0) (mm) | 65 | 65 | 65 |
| Nozzle inner diameter 2r(230) (mm) | 185 | 185 | 185 |
| Nozzle length L (mm) | 253 | 253 | 253 |
| Fluid flow speed $V_L$ (m/s) | 1.22 | 1.22 | 1.22 |
| Injection gas flow rate $Q_G$ (Nl/s) | 0.1 | 0.1 | 0.1 |
| Gas rate $R_G$ (%) | 2.5 | 2.5 | 2.5 |
| $R_G$ / $V_L$ | 2 | 2 | 2 |
| CFD flow state |   |   |   |
| Occurrence or non-occurrence of turbulence | Non-occurrence | Non-occurrence | Non-occurrence |
| Evaluation | ○ | ○ | ○ |

METHOD FOR USING UPPER NOZZLE

TECHNICAL FIELD

The present invention relates to a method for using an upper nozzle, and more particularly to a method for using an upper nozzle formed with a bore for allowing molten steel to flow therethrough and configured to be fitted into a well block attached to a bottom of a tundish, wherein the upper nozzle comprises a gas-permeable refractory member defining therein the bore, in order to suppress adhesion of inclusions and metals on a wall surface defining the bore.

BACKGROUND ART

When an upper nozzle formed with a bore for allowing molten steel to flow therethrough is used in a state in which it is fitted into a well block of a tundish, inclusions, such as alumina cluster, and metals are apt to adhere to a wall surface defining the bore. As a result, a flow passage in the bore is narrowed. In this case, it is necessary to remove the adhered substances by cleaning the inner hole using a bar or the like, or using an oxygen lance, thereby causing a hindrance to casting operation. In some cases, the bore is completely clogged by the adhered substances, thereby falling into a situation where it becomes impossible to continue the casting operation. Therefore, various techniques for preventing the occurrence of such adhesion have heretofore been invented and proposed.

For example, the following Patent Document 1 proposes an upper nozzle formed with a bore having a shape capable of creating a less energy loss or smooth (constant) molten steel flow to suppress the occurrence of the adhesion.

The following Patent Document 2 proposes a continuous casting insert nozzle (upper nozzle) formed with a bore for allowing molten steel to flow therethrough, wherein the insert nozzle comprises a porous refractory member (gas-permeable refractory member) defining the bore, thereby fulfilling a function of injecting inert gas into the bore.

CITATION LIST

Patent Document

Patent Document 1: WO 2009/113662 A.
Patent Document 2: JP-U 01-084860 A.

SUMMARY OF INVENTION

Technical Problem

The inventors of the present application who are also inventors of the upper nozzle disclosed in the Patent Document 1 tried to add a gas injection function as disclosed in the Patent Document 1 to the upper nozzle disclosed in the Patent Document 1, with a view to taking advantage of the excellent bore shape of the upper nozzle disclosed in the Patent Document 1 and further suppressing the occurrence of the adhesion.

However, even when the gas injection function was simply added to the upper nozzle disclosed in the Patent Document 1, the adhesion of inclusions and metals to a part of the bore-defining wall surface still occurred, supposedly due to variations in flow of molten steel and flow of injected gas, and kept growing, resulting in blocking of a molten metal flow passage, in some cases. Thus, there remains a need for further improvement, in regard to suppression of the occurrence of the adhesion.

Therefore, in an upper nozzle formed with a bore having a shape capable of creating a less energy loss or smooth (constant) molten steel flow to suppress the occurrence of adhesion of inclusions and metals in molten steel, and configured to additionally have a gas injection function, the present invention addresses a technical problem of providing a method of using the upper nozzle in such a manner as to allow the upper nozzle to further suppress the occurrence of the adhesion.

Solution to Technical Problem

According to one aspect of the present invention, there is provided a method of using an upper nozzle formed with a bore for allowing molten steel to flow therethrough, and configured to be fitted into a well block attached to a bottom of a tundish and to satisfy the following condition (1), wherein the upper nozzle comprises a gas-permeable refractory member defining therein the bore. The method comprises using the upper nozzle in such a manner as to satisfy the following conditions (2) and (3): (1) a cross-sectional shape of a wall surface defining the bore, taken along an axis of the bore, comprises a curve defined to have continuous differential values of r (z) with respect to z, between two curves represented by the following respective formulas: $\log(r(z))=(1/1.5)\times\log((H+L)/(H+z))+\log(r(L))$; and $\log(r(z))=(1/6)\times\log((H+L)/(H+z))+\log(r(L))$, where: L is a length of the upper nozzle; H is a calculational hydrostatic head height; and r (z) is an inner radius of the bore at a position downwardly away from an upper edge of the bore by a distance z, wherein: the calculational hydrostatic head height H is represented by the following formula: $H=((r(L)/r(0))^n-L)/(1-(r(L)/r(0))^n)$ (n=1.5 to 6); and the inner radius r (0) of the upper edge of the bore is equal to or greater than 1.5 times the inner radius r (L) of a lower edge of the bore; (2) $R_G \leq 4.3\times V_L$, where $R_G$ is a gas rate defined as a volume ratio of a flow rate $Q_G$ (Nl/s) of injection gas to a flow rate $Q_L$ (l/s) of molten steel flowing through the bore ($R_G=(Q_G/Q_L)\times 100(\%)$), and $V_L$ (m/s) is a flow speed of the molten steel at a lower edge of the upper nozzle; and (3) a gas injection amount from each of five regions of the bore-defining wall surface evenly divided in a height direction of the upper nozzle is equal to or less than 60% of a total gas injection amount.

The present invention will be described in detail below.

The upper nozzle of the present invention is premised on having the bore shape disclosed in the Patent Document 1, i.e., satisfying the above condition (1), so as to create a less energy loss or smooth (constant) molten steel flow. In the condition (1), the "curve defined between two curves represented by the following respective formulas: $\log(r(z))=(1/1.5)\times\log((H+L)/(H+z))+\log(r(L))$; and $\log(r(z))=(1/6)\times\log((H+L)/(H+z))+\log(r(L))$" is typically a curve represented by the following formula 1:

$$\log(r(z))=(1/n)\times\log((H+L)/(H+z))+\log(r(L)) \quad (n=1.5 \text{ to } 6) \qquad \text{Formula 1}$$

With reference to FIG. 1, details of the condition (1) will be described below. FIG. 1 is a conceptual diagram illustrating an axial section of a tundish and an upper nozzle. In FIG. 1, an upper nozzle 1 has a bore 4 for allowing molten steel to flow therethrough. The reference sign 5 indicates a large-diameter end edge of the bore (having an inner radius r (0)) at an upper edge 2 of the nozzle, and the reference sign 6 indicates a small-diameter end edge of the bore (having an inner radius r (L)) at a lower edge 3 of the nozzle. The bore 4 is defined by a wall surface 7 extending from the large-diameter end edge 5 to the small-diameter end edge 6. The upper edge 2 of the nozzle is an origin (zero point) of an aforementioned distance z.

In the condition (1), the bore-defining wall surface 7 illustrated in FIG. 1 is a smooth curve between two curves represented by the following respective formulas: log(r (z))=(1/1.5)×log((H+L)/(H+z))+log(r (L)); and log(r (z))=(1/6)×log((H+L)/(H+z))+log(r (L)), typically, a curve represented by the formula 1. The smooth curve is defined to have continuous differential values of r (z) with respect to z The cross-sectional shape of the bore-defining wall surface of the upper nozzle is based on an idea that a less energy loss or smooth (constant) molten steel flow is created by stabilizing a pressure distribution on the bore-defining wall surface in a height direction of the upper nozzle, as described below.

Although an amount of molten steel flowing through the bore of the upper nozzle is controlled by a sliding nozzle unit installed beneath the upper nozzle, energy for providing a flow speed of the molten steel is fundamentally a hydrostatic head of molten steel in the tundish. Thus, the flow speed v (z) of the molten steel at a position downwardly away from an upper edge of the bore (the upper edge of the upper nozzle) by a distance z is expressed as follows:

$$v(z)=k'(2g(H'+z))^{1/2} \qquad \text{Formula 2,}$$

where: g is a gravitational acceleration; H' is a hydrostatic head height of molten steel; and k' is a flow rate coefficient.

Meanwhile, during casting operation, an amount of molten steel in the tundish is kept approximately constant, i.e., the hydrostatic head height of molten steel is constant. However, it is known that molten steel located adjacent to a bottom surface of the tundish flows into the upper nozzle, instead of direct flow of molten steel located adjacent to a molten-steel level, into the upper nozzle. That is, it is effective to use, as the hydrostatic head height, a calculational hydrostatic head H having a large influence on a flow of molten steel from a vicinity of the bottom surface of the tundish adjacent to the upper edge of the upper nozzle, in place of an actual hydrostatic head H' of molten steel.

Thus, the formula 2 can be converted as follows: v (z)=k (2 g (H+z))$^{1/2}$, where k is a flow rate coefficient when using the calculational hydrostatic head H.

Then, a flow rate Q of molten steel flowing through the bore of the upper nozzle is a product of the flow speedy and a cross-sectional area A of the bore. Thus, the flow rate Q is expressed as follows:

$$Q=v(L)\times A(L)=k(2g(H+L))^{1/2}\times A(L),$$

where: L is a length of the upper nozzle; v (L) is a flow speed of molten steel at a lower edge of the bore; and A (L) is a cross-sectional area of the lower edge of the bore.

The flow rate Q is constant in a cross section taken along a plane perpendicular to an axis of the bore at any position within the bore. Thus, a cross-sectional area A (z) at a position downwardly away from the upper edge of the bore by the distance z is expressed as follows:

$$A(z)=Q/v(z)=k(2g(H+L))^{1/2}\times A(L)/k(2g(H+z))^{1/2}$$

Then, each of the right-hand and left-hand sides of this formula is divided by A (L) to obtain the following formula:

$$A(z)/A(L)=((H+L)/(H+z))^{1/2}$$

In this formula, A (z) and A (L) are expressed as follows: A (z)=πr (z)$^2$, and A (L)=πr (L)$^2$, where n is a ratio of the circumference of a circle to its diameter. Thus, the above formula is transformed as follows:

$$A(z)/A(L)=\pi r(z)^2/\pi r(L)^2=((H+L)/(H+z))^{1/2}$$

$$r(z)/r(L)=((H+L)/(H+z))^{1/4} \qquad \text{Formula 3}$$

Thus, the inner radius r (z) of the bore at an arbitrary position thereof is expressed as follows:

$$\log(r(z))=(1/4)\times\log((H+L)/(H+z))+\log(r(L)) \qquad \text{Formula 4}$$

The energy loss can be minimized by forming the bore-defining wall surface into a cross-sectional shape satisfying this condition (formula 4).

Meanwhile, an inner radius of the lower edge (small-diameter end edge) of the bore of the upper nozzle is determined by a required throughput. On the other hand, an inner radius of the upper edge (large-diameter end edge) of the bore can be set to be equal to or greater than 1.5 times the inner radius of the small-diameter end edge of the bore to thereby suppress a rapid pressure change which would otherwise occur in a vicinity of the upper edge of the bore. This is because, if the inner radius of the large-diameter end edge of the bore is less than 1.5 times the inner radius of the small-diameter end edge of the bore, a pressure (energy) occurring at the upper edge of the upper nozzle (large-diameter end edge of the bore) is highly fluctuated, causing generation of turbulence. Preferably, the inner radius of the large-diameter end edge of the bore is equal to or less than 2.5 times the inner radius of the small-diameter end edge of the bore. This is because, if the inner radius of the large-diameter end edge of the bore is increased beyond the lower limit, the upper end an opening (size) of a well block will be unrealistically increased.

On the other hand, in accordance with the formula 3, a ratio of the inner radius of the large-diameter end edge to the inner radius of the small-diameter end edge of the bore is expressed as follows:

$$r(0)/r(L)=((H+L)/(H+0))^{1/4}=1.5 \text{ to } 2.5 \qquad \text{Formula 5}$$

This means that, when respective inner radii of the large-diameter end edge and the small-diameter end edge of the bore are determined, the calculational hydrostatic head height H can be derived. That is, the calculational hydrostatic head height H is expressed as follows:

$$H=((r(L)/r(0))^4\times L)/(1-(r(L)/r(0))^4)$$

The formula 4 may be converted to log(r (z))=(1/n)×log ((H+L)/(H+z))+log(r (L)). In this formula, even if n is a number other than 4, a smoother molten steel flow than ever before can be formed, as long as the upper nozzle is formed with a bore defined by a wall surface having a cross-sectional shape obtained by changing a value of n. This has been verified in the Patent Document 1.

Further, as regards the calculational hydrostatic head height H, the parameter n can also be applied to convert the above formula as follows:

$$H=((r(L)/r(0))^n\times L)/(1-(r(L)/r(0))^n)$$

This has also been verified in the Patent Document 1.

That is, the formula 5 is converted as follows:

$$r(0)/r(L)=((H+L)/(H+0))^{1/n}=1.5 \text{ to } 2.5 \qquad \text{Formula 6}$$

Thus, if respective inner radii of the large-diameter end edge and the small-diameter end edge of the bore, and a ratio between the two inner radii, are determined, the calculational hydrostatic head height H in each value of n can be derived.

The above are the details of the condition (1) as the premise of the present invention. As a result of various researches based on this premise, the inventors found that turbulence in molten steel flowing through the bore of the tundish upper nozzle has a large influence on adhesion of inclusions and others on the bore-defining wall surface, and deeply relates to a flow rate of the molten steel and a flow rate of injection gas.

Now, a falling force $F_L$ of molten steel is represented by the following formula 7:

$$F_L = Q_L \times V_L \quad \text{Formula 7,}$$

where $Q_L$ is a flow rate (liter (l)/s) of the molten steel, and $V_L$ is a flow speed (m/s) of the molten steel at the lower edge (z=L) of the upper nozzle.

Similarly, a rising force $F_G$ of injection gas is represented by the following formula 8:

$$F_G = Q_G \times V_G \quad \text{Formula 8,}$$

where $Q_G$ is a flow rate (Normal liter (Nl)/s) of the injection gas, and $V_G$ is a rising speed (m/s) of a gas bubble.

It is considered that, in relation to collision between the molten steel falling force $F_L$ and the injection gas rising force $F_G$, turbulence occurs in the bore of the upper nozzle. From the formulas 7 and 8, a condition causing the turbulence is expressed in the following formula 9:

$$F_G > \alpha \times F_L \quad \text{Formula 9,}$$

where $\alpha$ is a constant.

That is, when the injection gas rising force $F_G$ becomes strong above a certain level in terms of a ratio with respect to the molten steel falling force $F_L$, turbulence occurs.

From the formulas 7, 8 and 9, the formula 9 is converted to $(Q_G \times V_G) > \alpha \times (Q_L \times V_L)$, and the following formula 10 is derived:

$$Q_G/Q_L > (\alpha \times V_L)/V_G \quad \text{Formula 10}$$

Assuming that $(Q_G/Q_L) \times 100 = R_G$, and $(\alpha/V_G) \times 100 = \beta$, $R_G$ is a volume ratio (%) of the injection gas flow rate $Q_G$ (Nl/s) to the molten steel flow rate $Q_L$ (l/s), i.e., a gas rate (%), and $\beta$ is substantially a constant because the gas bubble rising speed $V_G$ is deemed to be approximately constant ($V_G$=about 0.4 m/s) although it slightly changes depending on conditions such as a difference in bubble diameter of the injected gas. Thus, the formula 10 can be altered to the following formula 11:

$$R_G > \beta \times V_L \quad \text{Formula 11}$$

The formula 11 represents the condition causing turbulence in the bore of the upper nozzle, and, conversely, the following formula 12 represents a condition for avoiding turbulence in the bore of the upper nozzle:

$$R_G \leq \beta \times V_L \quad \text{Formula 12}$$

In accordance with this theory, a tundish upper nozzle was subjected to a fluid analysis based on a computer simulation under various conditions. The computer simulation was carried out on an assumption that gas is evenly injected from the entire bore-defining wall surface in a height direction of the upper nozzle, and the injected gas undergoes an expansion to six times its original volume.

The computer simulation-based fluid analysis was performed using fluid analysis software (trade name "Fluent Ver. 6.3.26 produced by ANSYS, Inc.). Input parameters for the fluid analysis software are as follows:

The number of calculational cells: about 120,000 (wherein the number can vary depending on a model)

Fluid: water (wherein it has been verified that evaluation for molten steel can also be performed in a comparative manner)

Density=998.2 kg/m$^3$

Viscosity=0.001003 Kg/(m·s)

Viscous Model: K-omega calculation

FIG. 2 presents one example of a result of the computer simulation-based fluid analysis. The CFD (Computational Fluid Dynamics) flow state indicates gas trajectories in the result of the computer simulation-based fluid analysis. A CFD flow state in which the gas trajectories are linearly generated in side-by-side relation was determined that no turbulence occurs. On the other hand, a CFD flow state in which the gas trajectories do not have linearity, i.e., a disordered or meandering state is clearly exhibited or a vortex is generated, was determined that turbulence occurs. In FIG. 2, the inventive shape means a shape of the bore (cross-sectional shape of a wall surface defining the bore) defined by a curve derived by the formula 1 when n=4. On the other hand, the conventional shape is configured such that, while the inner diameter of the upper edge (2r(0)), the inner diameter of the lower edge (2r(230)) and the length L of the upper nozzle are set to the same values as those in the inventive shape, a cross-sectional shape from the lower edge to a position upwardly away from the lower edge by a distance of 50 mm is maintained in the inner diameter of the lower edge (2r(230)), and a cross-sectional shape from the position upwardly away from the lower edge by a distance of 50 mm to the upper edge is formed as a linear, reverse tapered shape. Each of the inventive shape and the conventional shape is based on an assumption that the entire nozzle body is composed of a gas-permeable refractory member.

In the same manner as that in FIG. 2, the computer simulation-based fluid analysis was further performed under various conditions, while changing the nozzle shape, the fluid speed, the injection gas flow rate and others. A result of the analysis is presented in Table 1.

TABLE 1

| No. | Shape | Inner diameter 2r(L) mm | Inner diameter 2r(0) mm | Nozzle length L mm | Fluid flow rate $Q_L$ L/s | Bubble diameter mm | Gas flow rate $Q_G$ NL/min | Gas flow rate $Q_G$ NL/s | Fluid flow speed $V_L$ m/s | Gas rate $R_G$ % | $R_G/V_L$ | CFD flow state |
|---|---|---|---|---|---|---|---|---|---|---|---|---|
| 1 | Inventive | 32 | 65 | 265 | 1.44 | 5 | 5.00 | 0.083 | 1.78 | 5.8 | 3.3 | ○ |
| 2 | shape | 40 | 80 | 265 | 1.44 | 5 | 5.00 | 0.083 | 1.14 | 5.8 | 5.1 | × |
| 3 | (n-4) | 45 | 90 | 265 | 1.44 | 5 | 5.00 | 0.083 | 0.90 | 5.8 | 6.4 | × |
| 4 | | 70 | 140 | 265 | 6.78 | 5 | 5.00 | 0.083 | 1.76 | 1.2 | 0.7 | ○ |
| 5 | | 75 | 150 | 265 | 6.78 | 5 | 5.00 | 0.083 | 1.54 | 1.2 | 0.8 | ○ |
| 6 | | 80 | 160 | 265 | 6.78 | 5 | 5.00 | 0.083 | 1.35 | 1.2 | 0.9 | ○ |
| 7 | | 80 | 160 | 265 | 3.39 | 5 | 2.50 | 0.042 | 0.67 | 1.2 | 1.8 | ○ |

TABLE 1-continued

| No. | Shape | Inner diameter 2r(L) | Inner diameter 2r(0) | Nozzle length L | Fluid flow rate $Q_L$ | Bubble diameter | Gas flow rate $Q_G$ | | Fluid flow speed $V_L$ | Gas rate $R_G$ | | CFD flow |
|---|---|---|---|---|---|---|---|---|---|---|---|---|
| | | mm | mm | mm | L/s | mm | NL/min | NL/s | m/s | % | $R_G/V_L$ | state |
| 8 | | 40 | 80 | 265 | 1.44 | 5 | 2.50 | 0.042 | 1.14 | 2.9 | 2.5 | ○ |
| 9 | | 40 | 80 | 265 | 1.44 | 5 | 3.75 | 0.063 | 1.14 | 4.4 | 3.8 | ○ |
| 10 | | 45 | 90 | 265 | 1.44 | 5 | 3.75 | 0.063 | 0.90 | 4.4 | 4.8 | × |
| | | 45 | 90 | 265 | 1.44 | 5 | 3.42 | 0.057 | 0.90 | 4.0 | 4.4 | × |
| | | 45 | 90 | 265 | 1.44 | 5 | 3.11 | 0.052 | 0.90 | 3.6 | 4.0 | ○ |
| | | 45 | 90 | 265 | 1.44 | 5 | 3.26 | 0.054 | 0.90 | 3.8 | 4.2 | ○ |
| | | 45 | 90 | 265 | 1.44 | 5 | 3.34 | 0.056 | 0.90 | 3.9 | 4.3 | ○ |
| 11 | | 65 | 185 | 253 | 2.41 | 1 | 2.00 | 0.033 | 0.73 | 1.4 | 1.9 | ○ |
| 12 | | 65 | 185 | 253 | 2.41 | 1 | 4.00 | 0.067 | 0.73 | 2.8 | 3.8 | ○ |
| 13 | | 65 | 185 | 253 | 2.41 | 1 | 6.00 | 0.100 | 0.73 | 4.2 | 5.7 | × |
| 14 | | 65 | 185 | 253 | 2.41 | 1 | 8.00 | 0.133 | 0.73 | 5.5 | 7.6 | × |
| 15 | | 65 | 185 | 253 | 2.41 | 1 | 10.00 | 0.167 | 0.73 | 6.9 | 9.5 | × |
| 16 | | 65 | 185 | 253 | 4.05 | 1 | 2.00 | 0.033 | 1.22 | 0.8 | 0.7 | ○ |
| 17 | | 65 | 185 | 253 | 4.05 | 1 | 4.00 | 0.067 | 1.22 | 1.6 | 1.3 | ○ |
| 18 | | 65 | 185 | 253 | 4.05 | 1 | 6.00 | 0.100 | 1.22 | 2.5 | 2.0 | ○ |
| 19 | | 65 | 185 | 253 | 4.05 | 1 | 8.00 | 0.133 | 1.22 | 3.3 | 2.7 | ○ |
| 20 | | 65 | 185 | 253 | 4.05 | 1 | 10.00 | 0.167 | 1.22 | 4.1 | 3.4 | ○ |
| 21 | | 65 | 185 | 253 | 4.05 | 1 | 20.00 | 0.333 | 1.22 | 8.2 | 6.7 | × |
| 22 | | 65 | 185 | 253 | 4.05 | 2 | 10.00 | 0.167 | 1.22 | 4.1 | 3.4 | ○ |
| 23 | | 50 | 145 | 223 | 0.20 | 1 | 1.67 | 0.028 | 0.10 | 13.9 | 136.6 | × |
| 24 | | 50 | 145 | 223 | 0.50 | 1 | 1.67 | 0.028 | 0.25 | 5.6 | 21.9 | × |
| 25 | | 50 | 145 | 223 | 1.00 | 1 | 1.67 | 0.028 | 0.51 | 2.8 | 5.5 | × |
| 26 | | 50 | 145 | 223 | 1.50 | 1 | 1.67 | 0.028 | 0.76 | 1.9 | 2.4 | ○ |
| 27 | | 50 | 145 | 223 | 2.00 | 1 | 1.67 | 0.028 | 1.02 | 1.4 | 1.4 | ○ |
| 28 | | 50 | 145 | 223 | 1.00 | 1 | 0.83 | 0.014 | 0.51 | 1.4 | 2.7 | ○ |
| 29 | | 50 | 145 | 223 | 1.00 | 2 | 1.67 | 0.028 | 0.51 | 2.8 | 5.5 | × |
| 30 | | 50 | 145 | 223 | 1.50 | 2 | 1.67 | 0.028 | 0.76 | 1.9 | 2.4 | ○ |
| 31 | | 70 | 140 | 230 | 4.49 | 1 | 5.00 | 0.083 | 1.17 | 1.9 | 1.6 | ○ |
| 32 | Convention 1 shape | 70 | 140 | 230 | 4.49 | 1 | 5.00 | 0.083 | 1.17 | 1.9 | 1.6 | × |

As with the CFD flow state in FIG. 2, the column "CFD flow state" in Table 1 presents a result of a determination on the occurrence or non-occurrence of turbulence, based on gas trajectories, wherein the mark "○" denotes the non-occurrence of turbulence, and the mark "x" denotes the occurrence of turbulence.

FIG. 3 illustrates a graph obtained by plotting a relationship between the fluid flow speed $V_L$ (m/s), and the gas rate $R_G$ (%), i.e., a ratio of the injection gas flow rate $Q_G$ (Nl/min) to the fluid flow rate $Q_L$ (l/s), in the analysis result presented in Table 1.

As with the notation in Table 1, in FIG. 3, the non-occurrence of turbulence and the occurrence of turbulence in the CFD flow state are assorted, respectively, by the mark "○" and the mark "x". As a result, it was found that there is a clear correlation therebetween as indicated by the broken line in FIG. 3, i.e., the relationship in the formula 12, wherein β=4.3%/(m/s). This shows that, when the injection gas flow rate and others are adjusted in such a manner as to satisfy the following formula 13, the occurrence of turbulence in a flow of molten steel in the bore of the upper nozzle can be suppressed to thereby suppress the occurrence of the adhesion on the bore-defining wall surface:

$$R_G(\%) \leq 4.3 \times V_L(\text{m/s}) \qquad \text{Formula 13}$$

This is the condition (2) in the present invention.

Preferably, a gas injection pressure is set to 0.05 MPa or more. If the gas injection pressure is less than 0.05 MPa, it becomes difficult to obtain a stable gas outflow state, and a gas-curtain effect based on injected gas becomes weaker, so that the effect of suppressing the occurrence of the adhesion is deteriorated.

A balanced distribution of a gas injection amount in a height direction of the bore of the upper nozzle will be described below. FIGS. 4A to 4D illustrate CFD flow states as a result of the computer simulation-based fluid analysis, obtained by changing a gas injection amount from each of five regions B1 to B5 (see FIG. 5) of the bore-defining wall surface evenly divided in the height direction of the upper nozzle. In FIGS. 4A to 4D, a shape of the bore (cross-sectional shape of a wall surface defining the bore) is defined by a curve derived by the formula 1 when n=4.

FIG. 4A presents a result obtained by changing the gas injection amount from the region B3 located in the center of the upper nozzle in the height direction thereof. In FIG. 4A, the model (a) is configured such that gas is evenly injected from each of the regions including the region B3, i.e., the gas injection amount from each region is evenly set to 20% of the total injection gas flow rate, and the model (b) is configured such that 60% of the total injection gas flow rate is injected from the region B3, and the remaining flow rate is evenly injected from the remaining regions (10% each). In both of the models (a) and (b), no occurrence of turbulence was observed.

On the other hand, the models (c), (d) and (e) in FIG. 4A are configured such that the gas injection amount from the region B3 is set, respectively, to 70%, 80% and 100%. In the model (c), slight turbulence was observed, and, in the models (d) and (e), significant turbulence was observed. That is, it is assumed that, in these models, turbulence occurred because gas was intensively injected from the region B3, i.e., the gas flow rate in this region was locally and extremely different from those in the remaining regions.

Each of the models (a) to (e) in FIG. 4B is configured such that 60% of the total injection gas flow rate is injected from one of the regions B1, B2, B3, B4 and B5, and the remaining flow rate is evenly injected from each of the remaining regions (10% each). In the models (a) to (e) in FIG. 4B, no occurrence of turbulence was observed.

Each of the models (a) to (e) in FIG. 4C is configured such that 70% of the total injection gas flow rate is injected from one of the regions B1, B2, B3, B4 and B5, and the remaining flow rate is evenly injected from each of the remaining regions (7.5% each). In the models (a) to (e) in FIG. 4C, the occurrence of turbulence was observed.

In FIG. 4D, the model (a) is configured such that 5%, 30% and 5% of the total injection gas flow rate are injected, respectively, from the region B1, each of the regions B2, B3 and B4, and the region B5. Further, the model (b) is configured such that 0% of the total injection gas flow rate is injected from the region B1, and 25% of the total injection gas flow rate is injected from each of the regions B2, B3, B4 and B5. The model (c) is configured such that 0%, 20%, 30% and 5% of the total injection gas flow rate are injected, respectively, from each of the regions B1 and B2, the region B3, the region B4 and the region B5. In the models (a) to (c) in FIG. 4D, no occurrence of turbulence was observed.

Thus, it is assumed that no turbulence occurred as a result of avoiding local or intensive gas injection by setting the gas flow rate in each region to 60% or less.

The above analysis result shows that the gas injection amount from the bore-defining wall surface of the upper nozzle is preferably evenly set in the height direction of the upper nozzle, and, at least, a gas injection amount from each of five regions of the bore-defining wall surface evenly divided in the height direction of the upper nozzle is required to be equal to or less than 60% of the total gas injection amount. This is the condition (3) in the present invention.

In the present invention, as long as the above conditions (2) and (3) are satisfied, the gas-permeable refractory member may be configured to define the entire bore in the height direction as in the above models, or may be configured to define a part of the bore in the height direction. In either case, the tundish upper nozzle having the gas injection function can be produced by a well-known production method.

Effect of Invention

The present invention makes it possible to suppress adhesion of inclusions, such as alumina cluster, and metals, to the bore-defining wall surface of the upper nozzle. In addition, the present invention makes it possible to maintain a stable continuous casting operation without clogging of the bore of the upper nozzle to thereby avoid interruption of the casting operation and allow cast slab to ensure good quality with few defects so as to contribute to improvement in productivity, and others. Thus, the present invention has such great effects.

BRIEF DESCRIPTION OF DRAWINGS

FIG. 4A presents gas trajectories in a result of the computer simulation-based fluid analysis, obtained by changing a gas injection amount from each of five regions of the bore-defining wall surface evenly divided in a height direction of an upper nozzle.

FIG. 4B presents gas trajectories in a result of the computer simulation-based fluid analysis, obtained by changing the gas injection amount from each of the five regions of the bore-defining wall surface evenly divided in the height direction of the upper nozzle.

FIG. 4C presents gas trajectories in a result of the computer simulation-based fluid analysis, obtained by changing the gas injection amount from each of the five regions of the bore-defining wall surface evenly divided in the height direction of the upper nozzle.

DESCRIPTION OF EMBODIMENTS

The present invention will be described below, based on Examples.

Examples

The present invention was applied to an actual tundish in a continuous casting facility. A result of the application will be described below. It should be noted that the following Inventive Examples are shown only by way of specific examples of the present invention, but the present invention is not limited thereto.

Table 2 presents a result of a test performed by using, in an actual tundish, an upper nozzle under conditions, in each of Inventive Examples and Comparative Examples.

TABLE 2

| Nozzle shape | Inventive Example 1 | Inventive Example 2 | Inventive Example 3 | Inventive Example 4 | Comparative Example 1 | Comparative Example 2 | Comparative Example 3 | Comparative Example 4 |
|---|---|---|---|---|---|---|---|---|
| | Inventive Shape | | | | Conventional shape | | Inventive shape | |
| Fluid flow speed $V_L$ m/s | 1.7 | 1.8 | 1.8 | 1.2 | 1.7 | 1.2 | 1.1 | 0.5 |
| Injection gas flow rate Q Nl/s | 0.17 | 0.08 | 0.08 | 0.08 | 0.17 | 0.25 | 0.08 | 0.03 |
| Gas rate $R_G$ % | 2.9 | 5.8 | 1.2 | 1.9 | 2.9 | 5.6 | 5.8 | 2.8 |
| $R_G/V_L$ | 1.7 | 3.3 | 0.7 | 1.6 | 1.7 | 4.8 | 5.1 | 5.5 |
| Situation of adhesion of inclusions and others | ○ | Δ | Δ | Δ | × | × | × | × |

TABLE 2-continued

| Nozzle shape | Inventive Example 1 | Inventive Example 2 | Inventive Example 3 | Inventive Example 4 | Comparative Example 1 | Comparative Example 2 | Comparative Example 3 | Comparative Example 4 |
|---|---|---|---|---|---|---|---|---|
| | Inventive Shape | | | | Conventional shape | | Inventive shape | |
| Usable life (number of charges before nozzle change) | >16 ch | >10 ch | >12 ch | >8 ch | 8 ch | 8 ch | 5 ch | 5 ch |

Figure 1:
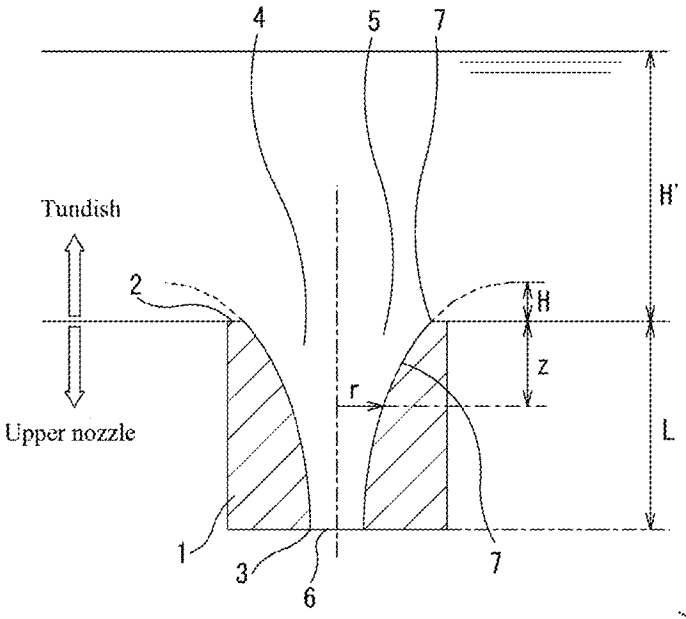
FIG. 1 is a conceptual diagram illustrating an axial section of a tundish and an upper nozzle.
Figure 3:
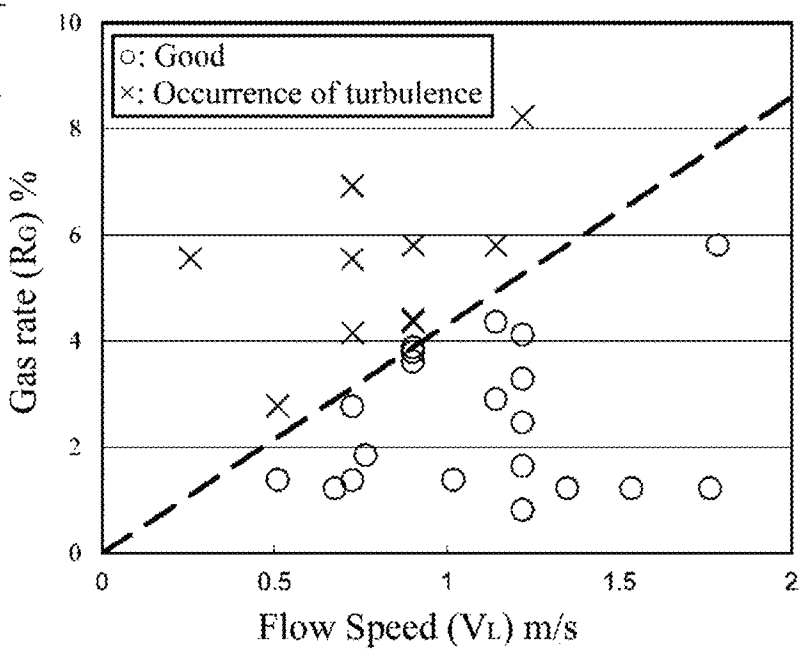
FIG. 3 illustrates a graph obtained by plotting a relationship between a fluid flow speed $V_L$ (m/s), and a gas rate $R_G$ (%), i.e., a ratio of an injection gas flow rate $Q_G$ to a fluid flow rate $Q_L$.
Figures 2, 5:
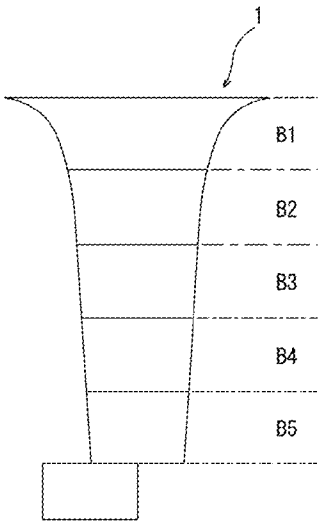
FIG. 2 presents one example of a result of computer simulation-based fluid analysis.
FIG. 5 illustrates the five regions of the bore-defining wall surface evenly divided in the height direction of the upper nozzle.
Figure 4D:
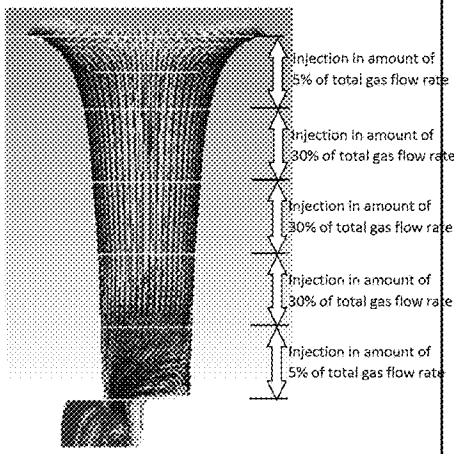
FIG. 4D presents gas trajectories in a result of the computer simulation-based fluid analysis, obtained by changing the gas injection amount from each of the five regions of the bore-defining wall surface evenly divided in the height direction of the upper nozzle.
Figure 4D:
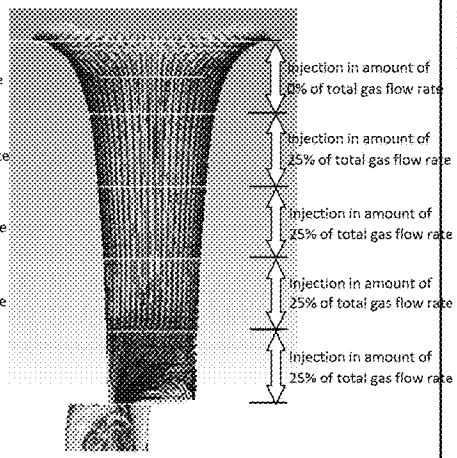
Figure 4D:
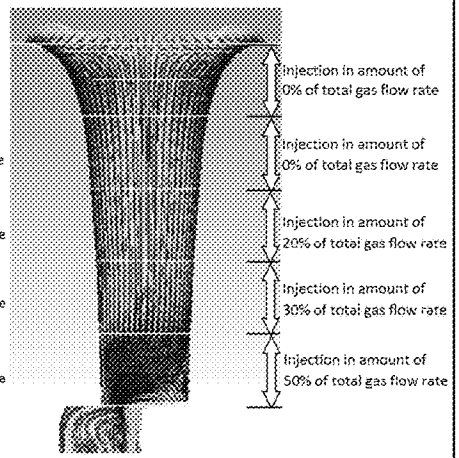

The nozzle shape in each of Inventive Examples 1 to 4 and Comparative Examples 3 and 4 is the inventive shape illustrated in FIG. 2, and the nozzle shape in each of Comparative Examples 1 and 2 is the conventional shape illustrated in FIG. 2. As regards the situation of adhesion of inclusions and others, the collected used upper nozzle was cut into halves and the situation of the adhesion was visually evaluated. The marks "○", "Δ" and "x" denote, respectively, a situation where almost no adhesion of inclusion and others is observed, a situation where adhesion of inclusion and others is observed but slightly, and a situation where significant adhesion of inclusion and others is observed. As regards the number of charges before nozzle change in Table 2, for example, ">16 ch" means that although the nozzle was changed after 16 charges by another reason, the nozzle was further usable in terms of the situation of adhesion of inclusion and others. In all of Inventive Examples and Comparative Examples, the gas injection amount from each of the five regions of the bore-defining wall surface of the upper nozzle was evenly set.

In Inventive Examples 1 to 4, the nozzle shape is the inventive shape satisfying the condition (1), and each upper nozzle is used in such a manner as to satisfy the condition (2): $R_G \leq 4.3 \times V_L$ ($R_G/V_L \leq 4.3$). Almost no or slight adhesion of inclusions and others was observed, and each upper nozzle had sufficient usable life.

On the other hand, in Comparative Example 1, the nozzle shape is the conventional shape which does not satisfy the condition (1), although the upper nozzle is used in such a manner as to satisfy the condition (2). In Comparative Example 2, the conditions (1) and (2) are not satisfied. In Comparative Examples 3 and 4, the condition (2) is not satisfied, although the condition (1) is satisfied. In all of Comparative Examples, significant adhesion of inclusions and others was observed, and each upper nozzle had short usable life.

As above, in Inventive Examples, the adhesion of inclusions and others could be suppressed, and the usable life can be increased 1.5 to 2 times or more.

LIST OF REFERENCE SIGNS

1: upper nozzle
2: upper edge of upper nozzle
3: lower edge of upper nozzle
4: bore
5: large-diameter end edge of bore
6: small-diameter end edge of bore
7: bore-defining wall surface

The invention claimed is:

1. A method comprising:

providing an upper nozzle formed with a bore, the nozzle being fitted into a well block attached to a bottom of a tundish, the upper nozzle including a gas-permeable refractory member defining therein the bore, the nozzle further comprising:

a cross-sectional shape of a wall surface defining the bore, taken along an axis of the bore, comprises a curve defined to have continuous differential values of r (z) with respect to z, between two curves represented by the following respective formulas: $\log(r(z)) = (1/1.5) \times \log((H+L)/(H+z)) + \log(r(L))$; and $\log(r(z)) = (1/6) \times \log((H+L)/(H+z)) + \log(r(L))$, where: L is a length of the upper nozzle; H is a calculational hydrostatic head height; and r (z) is an inner radius of the bore at a position downwardly away from an upper edge of the bore by a distance z, wherein: the calculational hydrostatic head height H is represented by the following formula: $H = ((r(L)/r(0))^n \times L)/(1-(r(L)/r(0))^n)$ (n=1.5 to 6); and the inner radius r (0) of the upper edge of the bore is equal to or greater than 1.5 times the inner radius r (L) of a lower edge of the bore;

flowing molten steel through the bore of the upper nozzle with a flow rate of $Q_L$ (l/s); and injecting gas into the upper nozzle with a gas rate of $R_G$, where $R_G \leq 4.3 \times V_L$, where $R_G$ is defined as a volume ratio of a flow rate $Q_G$ (Nl/s) of injection the injected gas to the flow rate $Q_L$ (l/s) of the molten steel flowing through the bore ($R_G = (Q_G/Q_L) \times 100(\%)$), and where $V_L$ is a flow speed of the molten steel at a lower edge of the upper nozzle, wherein injecting gas into the upper nozzle comprises:

defining five regions in the wall surface defining the bore, the wall surface being evenly divided in a height direction of the upper nozzle to define the five regions;

injecting the gas into at least three of the five regions of the wall surface, and injecting the gas such that a gas injection amount of the injected gas from each of the five regions of the wall surface is equal to or less than 60% of a total gas injection amount of the injected gas.

* * * * *